United States Patent [19]

Shioda et al.

[11] Patent Number: 4,951,881

[45] Date of Patent: Aug. 28, 1990

[54] PROCESS FOR CRUSHING HAFNIUM CRYSTAL BAR

[75] Inventors: Takuo Shioda, Sakura; Jiro Yamada, Tachikawa, both of Japan

[73] Assignee: Ishikawajima-Harima Heavy Industries Co., Ltd., Tokyo, Japan

[21] Appl. No.: 378,337

[22] Filed: Jul. 11, 1989

[30] Foreign Application Priority Data

Sep. 26, 1988 [JP] Japan ..... 63-238988

[51] Int. Cl.[5] ..... B02C 19/12

[52] U.S. Cl. ..... 241/23; 241/DIG. 37

[58] Field of Search ..... 75/5 R; 241/23, 27, 241/DIG. 37, 65, 66, 67, 270

[56] References Cited

U.S. PATENT DOCUMENTS

| | | | |
|---|---|---|---|
| 2,892,697 | 6/1959 | Davies et al. | 241/23 X |
| 4,205,964 | 6/1980 | Hill | 241/27 X |
| 4,509,695 | 4/1985 | Bessman | 241/DIG. 37 X |
| 4,647,304 | 3/1987 | Petkovic-Luton et al. | 75/5 R |
| 4,771,950 | 9/1988 | Coblenz et al. | 241/23 X |

FOREIGN PATENT DOCUMENTS

| | | | |
|---|---|---|---|
| 17054 | 6/1970 | Japan | 241/23 |
| 2134014 | 8/1984 | United Kingdom | 241/23 |

*Primary Examiner*—Mark Rosenbaum

*Attorney, Agent, or Firm*—Dykema Gossett

[57] ABSTRACT

A process for crushing a hafnium (Hf) crystal bar comprises the steps of maintaining the Hf crystal bar at an extremely low temperature by holding the crystal bar in contact with a cryogenic refrigerant and crushing the crystal bar at the extremely low temperature by clamping and compressing the crystal bar between nickel (Ni)-base superalloy members. An apparatus for crushing the Hf crystal bar comprises a Ni-base superalloy-made container for containing the cryogenic refrigerant, the container having a bottom portion capable of being selectively opened and closed, a heat insulator for covering the container filled with the cryogenic refrigerant so as to maintain the interior of the container at the extremely low temperature, Ni-base superalloy-made pressing terminals for clamping the Hf crystal bar therebetween in the container, and a pressing device for exerting pressure on the pressing terminals so as to compress and crush the Hf crystal bar.

8 Claims, 2 Drawing Sheets

PROCESS FOR CRUSHING HAFNIUM CRYSTAL BAR

BACKGROUND OF THE INVENTION

1. Technical Field

This invention relates to a process for crushing a hafnium crystal bar, and more particularly to a process for crushing a hafnium crystal bar in order to produce a starting material for the production of a high-purity fine powder of hafnium having superior toughness and heat resistance.

2. Background Art

Recently, hafnium (Hf) has drawn attention in various fields because of its superior toughness and heat resistance. For instance, in the field of precision casting, unidirectionally solidified materials of super heat-resistant nickel-base alloys with Hf contained therein are being commercialized. In the field of powder metallurgy, also, not only Hf-containing heavy alloys and dispersion-strengthened alloys but HfC- or HfN-containing composite carbides are being commercialized.

In the former case, hafnium has been added in the form of crystal bars in the production of a master ingot as a starting material or a raw material. The Hf crystal bars in their uncrushed state have led to low yields or have caused segregation.

In the latter case, on the other hand, it has been the common practice to reduce a hafnium salt by hydrogen to form Hf or then form a carbide therefrom. In the process of production of the alloys or carbides, however, the decomposition or escape of unrequired elements or groups contained in the Hf salt has often resulted in formation of vacancies and a disordered crystal structure in the final product.

The above-mentioned problems are solved if there is a crushed product of Hf crystal bars of maximum purity as the starting or raw material. Because of the high hardness, high toughness and the close-packed hexagonal crystal structure of the Hf crystal bars, however, there has not been a conventional technique to crush the Hf crystal bars, and commercialization has therefore been carried out simply by crushing Hf sponge.

When the Hf sponge is crushed for use as a raw material for a variety of uses, the physical properties and workability of the final product are lowered, because of the high nitrogen and oxygen contents of the raw material and the susceptibility of hafnium to the effects of interstitial impurities such as nitrogen and oxygen.

In addition, in the process of producing the Hf sponge, chlorine and magnesium are left in the Hf sponge. Therefore, the Hf sponge has a high content of chlorine and magnesium, which leads to a deterioration of the physical properties of the final product.

SUMMARY OF THE INVENTION

It is accordingly an object of this invention to provide a process for crushing a hafnium crystal bar by which it is possible to obtain a crushed product of Hf crystal bars of maximum purity as a raw material.

Because of the high hardness, high toughness and the close-packed hexagonal crystal structure of the hafnium crystal bars, it has not hitherto been contemplated to crush the hafnium crystal bars by utilizing low-temperature brittleness. One aspect of the present invention therefore resides in recognition that the embrittling effect of low temperature on hafnium can be positively used, which effect has heretofore been considered to be slight.

One mode of the process for crushing a hafnium crystal bar according to this invention comprises the steps of maintaining the Hf crystal bar at an extremely low temperature by holding the crystal bar in contact with a cryogenic refrigerant, and crushing the Hf crystal bar at the extremely low temperature by clamping and compressing the crystal bar between nickel (Ni)-base superalloy members. In this process, with the Hf crystal bar maintained at the extremely low temperature by holding the crystal bar in contact with the cryogenic refrigerant, the low-temperature embrittlement effect is enhanced, and the heat generation upon application of pressure to the crystal bar is restrained. In this condition, the Hf crystal bar is clamped and compressed between the Ni-base superalloy members, whereby the Hf crystal bar is crushed through the generation of permanent strain, because the Ni-base superalloy is superior to hafnium in hardness and toughness and is insusceptible to low-temperature embrittlement.

The process of the present invention may be carried out using apparatus for crushing a hafnium crystal bar which comprises a container made of a Ni-base superalloy for containing a cryogenic refrigerant, the container having a bottom portion capable of being opened and closed as desired, a heat insulator for covering the container filled with the cryogenic refrigerant so as to maintain the interior of the container at an extremely low temperature, pressing terminals made of a Ni-base superalloy for clamping the Hf crystal bar therebetween in the container, and pressing means for exerting a pressure on the pressing terminals to compress and crush the Hf crystal bar. In this apparatus, the container is formed of the Ni-base alloy, whereby the cryogenic refrigerant is safely contained. With the container covered by the heat insulator, the interior of the container filled with the cryogenic refrigerant is maintained at the extremely low temperature. The Hf crystal bar is clamped between the Ni-base superalloy-made pressing terminals in the interior of the container maintained at the extremely low temperature, and a pressure is exerted on the pressing terminals by the pressing means to compress the Hf crystal bar, whereby the Hf crystal bar is crushed through the generation of permanent strain therein. Since the bottom portion of the container is capable of being opened and closed as desired, it is easy to remove the crushed Hf crystals from the container.

As has been described above, according to this invention, it is possible to obtain a crushed product of Hf crystal bars of maximum purity as a raw material.

DESCRIPTION OF THE PREFERRED EMBODIMENT

One preferred embodiment of this invention will now be described below, based on the accompanying drawings.

Figure 1:
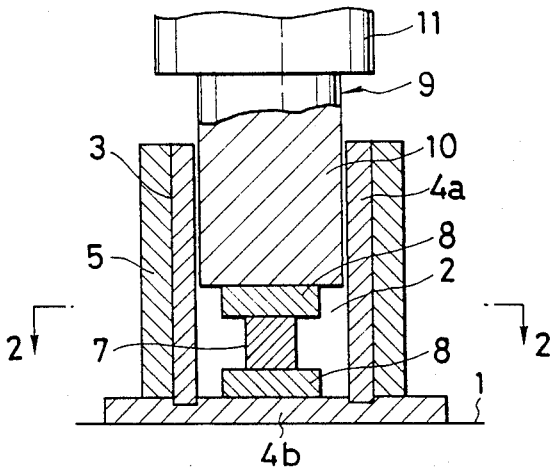
FIG. 1 is a side view showing one embodiment of apparatus for crushing a hafnium crystal bar used in the process according to this invention.
Figure 2:
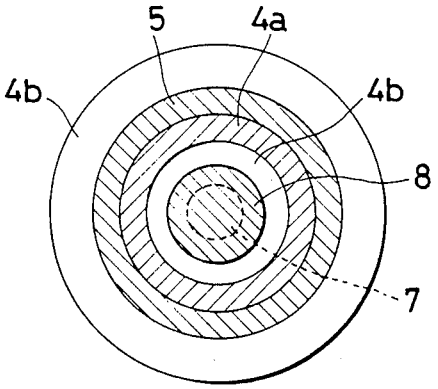
FIG. 2 is a view taken along the line II—II of FIG. 1.

Referring first to FIGS. 1 and 2, the present description deals with one embodiment of the apparatus for crushing a hafnium crystal bar used in carrying out the process according to this invention. As shown in the figures, disposed on a base 1 is a crushing container 3 for containing a cryogenic refrigerant 2 therein. The cryogenic refrigerant 2 may be, for example, liquid argon. The container 3 is formed of a Ni-base superalloy, and comprises a side wall consisting of a tubular cylinder 4*a* and a circular disk-like bottom portion 4*b*. The cylinder 4*a* is, for example, 100 mm in diameter and 180 mm in height. The cylinder 4*a* is detachably fitted to the bottom portion 4*b*. The outer periphery of the side portion of the container 3 is covered with a heat insulator 5 so as to maintain the interior of the container 3 at an extremely low temperature. A hafnium crystal bar 7 to be crushed is disposed in the container 3. A pair of circular disk-like pressing terminals 8 for clamping the Hf crystal bar 7 therebetween are provided in the container 3. The pressing terminals 8 are formed of a Ni-base superalloy. As shown, the pressing terminals 8 are located respectively on the upper and lower sides of the Hf crystal bar 7. The pressing terminal 8 on the lower side is disposed on the bottom portion 4*b* of the container 3, whereas the pressing terminal 8 on the upper side is contacted by pressing means 9 which exerts a pressure on the upper pressing terminal 8 to compress and crush the Hf crystal bar 7 clamped between the upper and lower pressing terminals 8. Pressing means 9 is employed that includes a press head 10 of a 300-ton press (300-T press) which is 98 mm in diameter. Numeral 11 in the figure denotes a pressing guide as an aid to vertical compression and stroke in the container 3.

Figure 3:
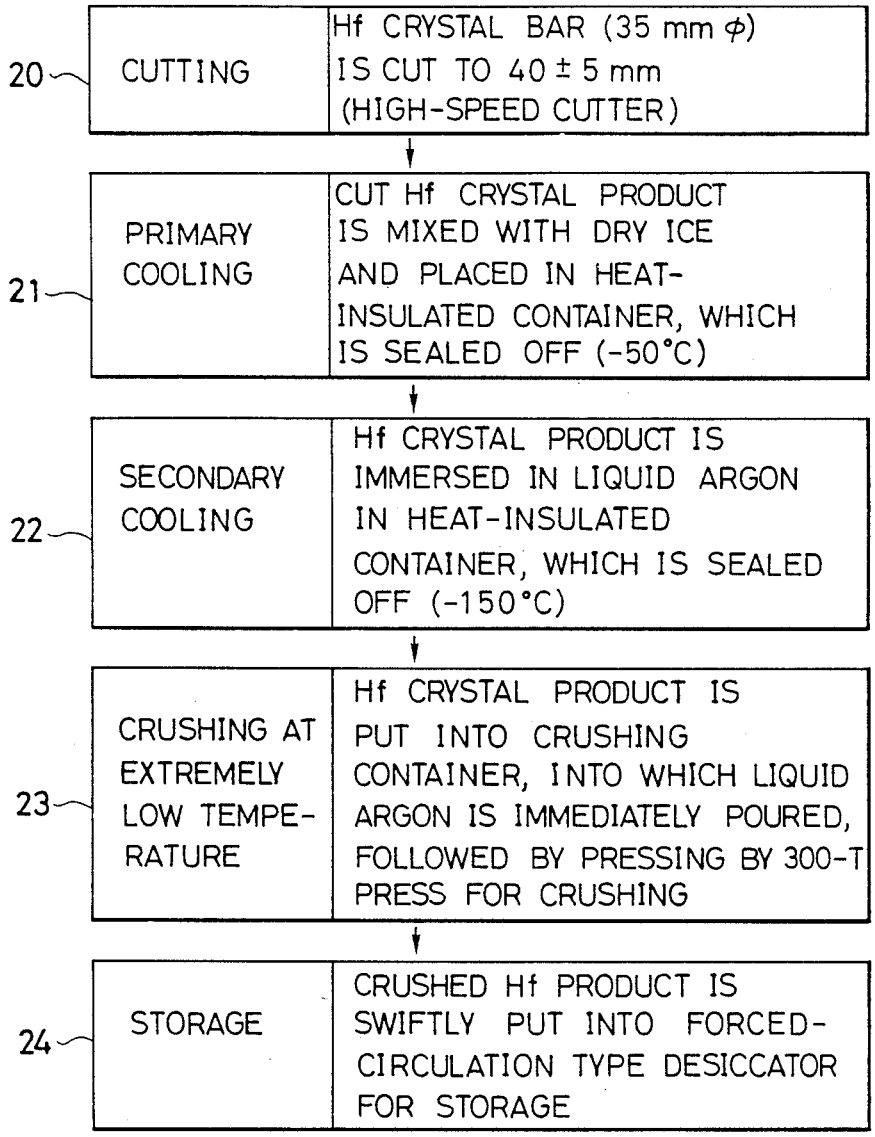
FIG. 3 is a flowchart of one embodiment of the process for crushing a hafnium crystal bar according to this invention.

The process for crushing a hafnium crystal bar according to this invention, as carried out with the use of the apparatus constructed as described above, will now be explained in detail below referring to FIG. 3. First, the Hf crystal bar 7 with a 35 mm diameter is cut (20) to a size of 40±5 mm by a high-speed cutter. Next, the thusly cut Hf crystal bar 7 is mixed with dry ice within a heat-insulated, hermetically sealed container (not shown) separately prepared, followed by sealing off the heat-insulated, hermetically sealed container to perform primary cooling (21) to a temperature of −50 degrees C. (°C.). The Hf crystal bar 7 subjected to primary cooling (21) then undergoes secondary cooling (22) to a temperature of about −150° C. or below by placing the crystal bar 7 in another heat-insulated, hermetically sealed container filled with liquid argon and sealing off the liquid argon-filled container. After the secondary cooling (22), the lower pressing terminal 8 is disposed on the bottom portion 4*b* in the crushing container 3. The Hf crystal bar 7 which had been subjected to the second cooling (22) is then placed on the lower pressing terminal 8, and the upper pressing terminal 8 is located on the Hf crystal bar 7 to clamp the Hf crystal bar 7 between the pressing terminals 8. Simultaneously, liquid argon is poured into the container 3 to bring the Hf crystal bar 7 into contact with the cryogenic refrigerant 2, thereby maintaining the Hf crystal bar 7 at an extremely low temperature of not higher than −150° C. The container 3 is made of the Ni-base superalloy, whereby the cryogenic refrigerant 2 is safely contained. Further, with the container 3 covered with the heat insulator 5, the interior of the container 3 filled with the cryogenic refrigerant 2 is maintained at the extremely low temperature of −150° C. or below. Thereafter, a pressure of about 9 kg/mm$^2$ is exerted on the upper pressing terminal 8 by the press head 10 of the 300-T press used as the pressing means 9, thereby compressing the Hf crystal bar 7 in a single direction by the upper and lower pressing terminals 8, with the result of crushing (23) of the Hf crystal bar 7. When the Hf crystal bar 7 is maintained at the extremely low temperature through contact with the cryogenic refrigerant 2 such as liquid argon, the low-temperature embrittlement effect is enhanced, and the heat generation upon application of the pressure to the crystal bar 7 is restrained. When the Hf crystal bar 7 in this condition is clamped and compressed between the upper and lower pressing terminals 8 made of the Ni-base superalloy, the Hf crystal bar 7 is crushed through the generation of permanent strain, because the Ni-base superalloy is superior to Hf in hardness and toughness and is insusceptible to low-temperature embrittlement. The cylinder 4*a* of the container 3 not only contains the cryogenic refrigerant 2 but serves to aid the vertical compression and prevent the scattering of the crushed Hf crystals. The steps of primary cooling (21), secondary cooling (22) and low-temperature crushing (23) are repeated in series three or four times. It is possible to perform a continuous crushing of three or four pieces of the cut Hf crystal bars 7. Subsequently, the cylinder 4*a* of the container 3 is detached from the bottom portion 4*b*, and the crushed Hf crystals are swifly taken out and are stored (24) in a circulating type desiccator (not shown).

The characteristic values in this invention are optimal values obtained from various experimental results. The basic feature of the values lies in that the Hf crystal bar 7 is cooled to and maintained at a temperature of not higher than −150° C. to embrittle the crystal bar 7 and to cool the large quantity of heat generated upon release of the bonding energy of the Hf crystal, thereby enhancing the crushing efficiency so as to enable crushing of the Hf crystal bar under a compressive pressure of about 9 kg/mm$^2$. A temperature higher than −150° C. hinders the enhancement of the embrittling effect and makes it impossible to crush the Hf crystal bar with a compressive pressure less than about 9 kg/mm$^2$.

The crushed Hf crystal product thusly obtained has the following merits.

When the crushed product is used as is as an alloying additive in the production of a master ingot for obtaining precision castings, such as directionary solidified castings or single crystal castings, or in the production of an electrode alloy for obtaining a forging alloy, a high yield can be expected in comparison with the prior approach of adding Hf crystal bars. Namely, whereas the yield with the addition of the Hf crystal bars is 70 to 80%, the yield with the addition of the crushed Hf crystal product produced according to this invention is 99 to 100%. For this purpose, Hf sponge with a high N, O, Cl or Mg content is not usable.

In addition, the crushed Hf crystal product produced according to this invention may be used as a raw material in a "Process For Producing High-Purity Fine Powder of Reactive Metal and Apparatus Therefor," disclosed in Japanese Patent Application Nos. 210620/1988 and 218486/1988, respectively filed on Aug. 26, 1988 and Sept. 2, 1988, both owned by the present assignee, the entire disclosures of which are incorporated by reference herein. When the crushed Hf crystal product is used after being pulverized by the process for producing a high-purity fine powder of a reactive metal, the fine powder obtained is usable as a raw material for a variety of uses. It is impossible to compare such a use with a corresponding use according to the prior art because there is not any conventional use of the Hf crystal material in pulverized form as a raw material. The use of the crushed Hf crystal product obtained according to this invention after pulverization as a raw material, however, definitely leads to markedly suppressed penetration of impurity elements into the atomic arrangement of the final product, as compared to the case where hafnium carbide (HfC) is used as a raw material, namely, the case where a Hf compound is reduced by hydrogen to where Hf and HfC is produced therefrom. Moreover, when the crushed Hf crystal product obtained according to this invention is used after pulverization as a raw material, the final product obtained is free of disorder in the arrangement of atoms arising from the escape of impurity elements or formation of vacancies and has stable qualities and properties with good reproducibility.

We claim:

1. A process for crushing a hafnium crystal bar, comprising the steps of:

(A) maintaining the hafnium crystal bar at an extremely low temperature by holding the hafnium crystal bar in contact with a cryogenic refrigerant; and (B) crushing the hafnium crystal bar at the extremely low temperature by clamping and compressing the hafnium crystal bar between nickel-base superalloy members.

2. A process set forth in claim 1, wherein liquid argon is used as the cryogenic refrigerant.

3. A process set forth in claim 1, wherein the extremely low temperature is −150 degrees C. (°C.) or below, and the compression of step (B) is carried out under a pressure of at least about 9 kg/mm$^2$.

4. A process set forth in claim 2, wherein the extremely low temperature is −150° C. or below compression of step (B) is carried out under a pressure of at least about 9 kg/mm$^2$.

5. A process for crushing a hafnium crystal bar, comprising the steps of:

(A) subjecting the hafnium crystal bar to primary cooling by mixing the hafnium crystal bar with dry ice;

(B) subjecting the hafnium crystal bar after cooling in step (A) to secondary cooling by bringing the hafnium crystal bar into contact with a cryogenic refrigerant, so as to cool the hafnium crystal bar to an extremely low temperature; and (C) crushing the hafnium crystal bar at the extremely low temperature by clamping and compressing the hafnium crystal bar between nickel-base superalloy members.

6. A process set forth in claim 5, wherein liquid argon is used as the cryogenic refrigerant.

7. A process set forth in claim 5, wherein the extremely low temperature is −150° C. or below, and the compression of step (C) is carried out under a pressure of at least about 9 kg/mm$^2$.

8. A process set forth in claim 6, wherein the extremely low temperature is −150° C. or below, and the compression of step (C) is carried out under a pressure of at least about 9 kg/mm$^2$.

* * * * *